United States Patent [19]

Lugosi

[11] 4,085,606

[45] Apr. 25, 1978

[54] HYDROSTATIC EXTRUSION APPARATUS FOR PRODUCING HOLLOW ELONGATED BODIES OF RECTANGULAR CROSS SECTION

[75] Inventor: Robert Lugosi, Monroeville, Pa.

[73] Assignee: Westinghouse Electric Corporation, Pittsburgh, Pa.

[21] Appl. No.: 748,971

[22] Filed: Dec. 9, 1976

[51] Int. Cl.[2] ..... B21D 22/10

[52] U.S. Cl. ..... 72/60; 72/264

[58] Field of Search ..... 72/60, 264, 265, 269

[56] References Cited

U.S. PATENT DOCUMENTS

| | | | |
|---|---|---|---|
| 2,638,213 | 5/1953 | Clark | 72/269 |
| 3,580,038 | 5/1971 | Andreassion | 72/264 |
| 3,712,103 | 1/1973 | Malegue | 72/264 |
| 3,751,957 | 8/1973 | Nilsson | 72/60 |
| 3,807,032 | 4/1974 | Nilsson | 72/60 |
| 3,808,860 | 5/1974 | Yamaguchi et al. | 72/60 |
| 3,946,584 | 3/1976 | Yamasaki et al. | 72/60 |

*Primary Examiner*—Leon Gilden
*Attorney, Agent, or Firm*—J. W. Keen

[57] ABSTRACT

A method and an apparatus for manufacturing elongated, hollow bodies of rectangular cross section by means of hydrostatic extrusion. The method and apparatus utilize a mandrel and billet of novel construction. The mandrel cooperates with a die and has a forming tip comprising a cylindrical portion, a transition portion, and a rectangular portion. The transition portion provides a tapered surface which extends from the cylindrical portion to the rectangular portion. The billet has a leading end which is extruded first and which has a simple geometry comprising two tapered surfaces situated axially adjacent to each other and being of different taper. The billet has an axially extending hole through which the mandrel is inserted. Due to their construction and relative positioning, a hydrostatic seal is provided between the billet's leading end and the die and between the mandrel and an inner wall of the billet which bounds its axially extending hole. The uniform flow between the mandrel and die during extrusion yields a hollow, elongated product of rectangular shape whose corners are free of folds and other metal forming defects. Thus, this method and the apparatus for performing the method enables one step hydrostatic extrusion of hollow, elongated bodies of rectangular cross section with the advantages of providing excellent extrusion lubrication and complete hydrostatic sealing between the die, billet, and mandrel.

5 Claims, 11 Drawing Figures

FIG.1A
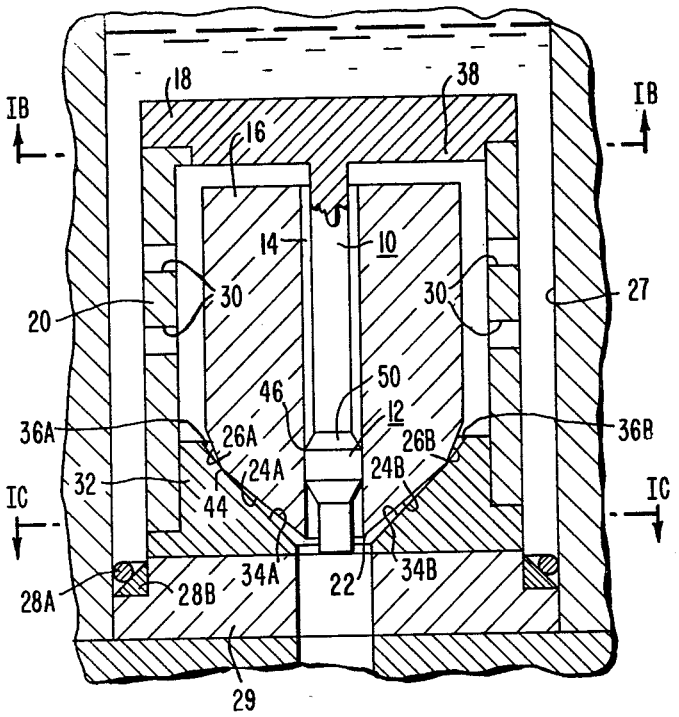
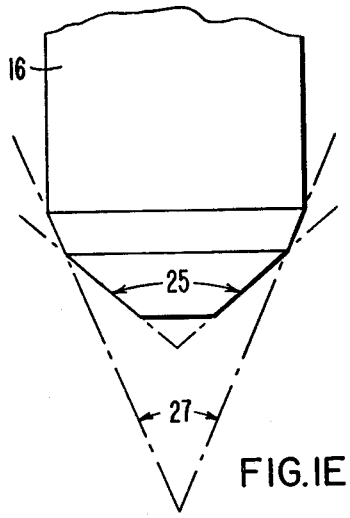
FIG.1E
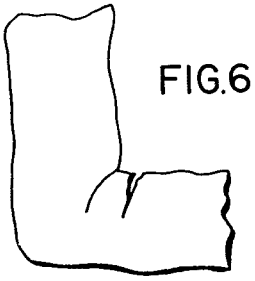
FIG.6
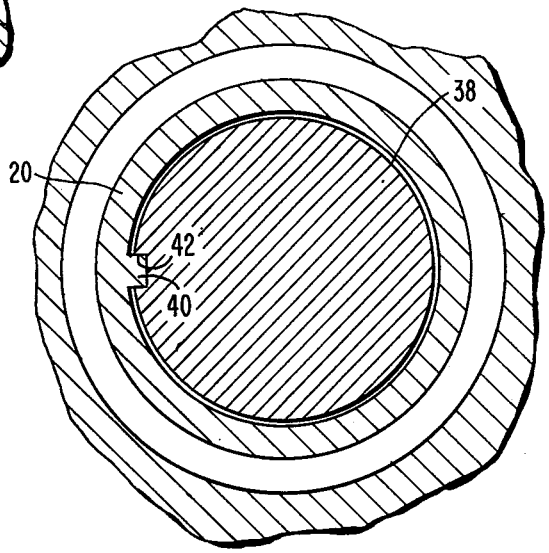
FIG.1B
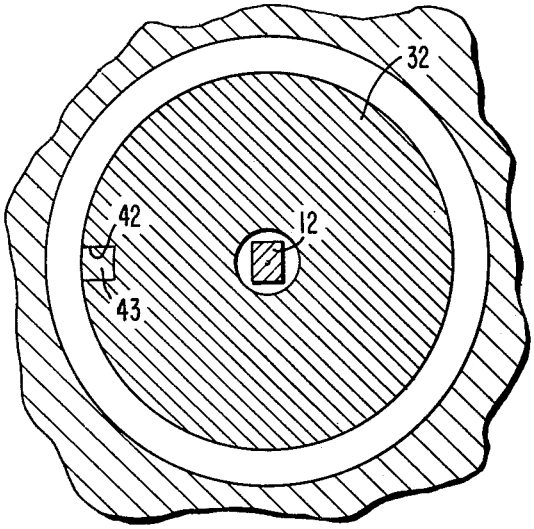
FIG.1C

HYDROSTATIC EXTRUSION APPARATUS FOR PRODUCING HOLLOW ELONGATED BODIES OF RECTANGULAR CROSS SECTION

BACKGROUND OF THE INVENTION

1. Field of the Invention

This invention relates to manufacturing hollow, elongated bodies by means of hydrostatic extrusion, and more particularly to a method and an apparatus for use in manufacturing hollow, elongated bodies of generally rectangular cross section.

2. Description of the Prior Art

At the present time many hollow tubes of rectangular cross section are manufactured by performing the following operations: extruding a cylindrical tube; drawing that tube in a first direction; annealing that tube; drawing that tube in a second direction; and annealing that tube. The annealing processes may be eliminated or their number reduced by proper selection of reduction ratios and utilization of different materials. The aforementioned manufacturing process can have several product quality problems associated therewith. These include poor inside corner integrity which is caused by cracks and folds which are present along the inside corners of the final product and are the result of non-uniform metal distribution occurring during the multiple drawing operations required in that manufacturing process. The outside surface of the rectangular cross section tubes produced by the drawing process often has an undesirable, wavy characteristic as opposed to a desirable flat surface geometry.

A rectangularly shaped tubular product, of conductive material, is often used to provide cooling water passages in generator stator windings where it is interspersed with many other solid, current carrying conductors. Poor inside corner integrity of the cooling water passages can cause leakage and costly generator shut downs and overhauls. Non-planar side geometry of the rectangular tubes can cause difficulty in winding the stator and supplying sufficient current carrying conductors in the limited space provided for them. Therefore, formation of such conductors calls for a very reliable technique.

Hydrostatic extrusion is a recently developed metal forming technique which combines the benefits of large work piece reductions with good lubrication characteristics. Conceptually, the work piece is positioned in a high pressure chamber with its leading end situated in registry with a die. The extrusion forces are then generated by a moving ram or other pressurizing device and transmitted to the work piece through a pressure transmitting medium. Such hydrostatic extrusion can be utilized to effect a one step rectangularly shaped tube forming process which eliminates the drawing method that is associated with many of the previously mentioned product imperfections. Patents illustrating hydrostatic extrusion processes for the manufacture of symmetrically round products are U.S. Pat. No. 3,712,103 and 3,727,444.

U.S. Pat. No. 3,808,860 proposes a hydrostatic extrusion process and apparatus for producing tubular bodies including bodies having cross sections of noncylindrical shape, such as rectangular, as exemplified in its FIG. 7. The apparatus and method proposed are considered to require undesired complexity in die and billet configurations and to provide relatively poor lubrication characteristics between the die and billet which would hinder uniform billet flow and reliable final product geometry, including inside corner integrity.

SUMMARY OF THE INVENTION

In general, a hydrostatic extrusion mechanism is presented which is capable of producing tubular bodies of generally rectangular cross section by inserting a mandrel through an opening in a billet with the mandrel having its forming end disposed adjacent to a die. The mandrel's forming end and the die are shaped so as to cooperate in forming a narrowing path for the billet to follow during its extrusion. A mandrel bridge surrounds the billet and separates the die from a flared end of the billet which is located axially opposite said billet's forming end. A pressure chamber surrounds the mandrel bridge and the flared end of the mandrel and contains fluid which, when pressurized, forces the leading end of the billet into sealing contact with the die simultaneously with forcing the billet's inner wall into sealing contact with the mandrel. By further increasing the pressure of the fluid to a predetermined value, the extrusion of tubular bodies is thereby affected.

The billet has a leading tip which is tapered so as to provide good sealing characteristics and to cooperate with the die in trapping the fluid therebetween thus securing good, initial lubrication.

BRIEF DESCRIPTION OF THE DRAWINGS

The objects and advantages of this invention will become more apparent from reading the following detailed description in connection with the accompanying drawing, in which:

FIG. 1A is a partial sectional view of a hydrostatic extrusion apparatus with the work piece assembled therein;

FIG. 1B is a sectional view taken on line AA of FIG. 1A;

FIG. 1C is a sectional view taken on line BB of FIG. 1A;

FIG. 1E illustrates the conical apex angles as measured on the billet shown in FIG. 1A;

FIG. 6 illustrates a part of the product cross section which was made by previous methods of manufacture.

DESCRIPTION OF THE PREFERRED EMBODIMENT

Figure 1D:
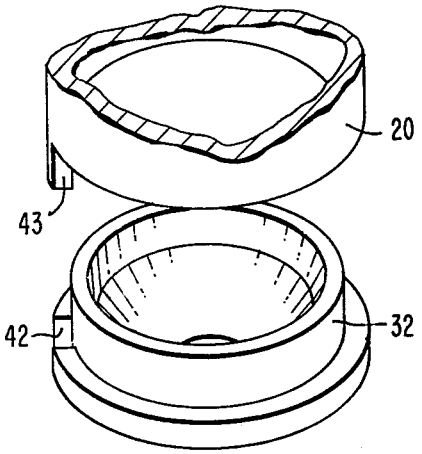
FIG. 1D is a pictorial view of the die and mandrel bridge illustrated in FIG. 1A when they have been separated.

Referring now to the drawing in detail, FIG. 1A shows a hydrostatic extrusion apparatus used for producing tubular products which have rectangular cross sections. Mandrel 10 has a forming end 12 which is inserted through an axially extending hole 14 in billet 16 until its flared end 18 contacts mandrel bridge 20. Billet 16 has a leading extrusion end 22 which has two frusto conical surfaces situated axially adjacent to each other and being of different taper. The subtended angle known as a conical apex angle separates surface 24A and 24B and is 99° by example while the conical apex angle between surfaces 26A and 26B is 46°, also by example. Conical apex angles 99° and 46° are shown in FIG. 1E defined by dotted lines and labeled as 25 and 27 respectively. Pressure chamber 27 surrounds mandrel bridge 20 and contains a pressure transmitting fluid which communicates through mandrel bridge holes 30 to a volume defined by mandrel bridge 20, billet 16, mandrel 10, and die 32.

O-ring 28A and mitre ring 28B respectively provide low pressure and high pressure sealing between pressure chamber 27 and die support 29 preventing flow of pressure transmitting fluid therebetween during all stages of the extrusion process.

Die 32 is, by example, a variable land length die having two axially adjacent frusto conical surfaces which are indicated in FIG. 1A as being 34A and 34B and 36A and 36B. Surface 34A and 34B define an included angle therebetween which is by example 103° and surface 36A and 36B delimit the sides of an angle which is, by way of illustration, 70°.

Flared end 18 of mandrel 10 extends radially for such distance as to be flush with the outer surface of mandrel bridge 20 and has a smaller radially extending portion 38 that is slightly smaller than the inside surface of mandrel bridge 20. A portion of mandrel bridge 20, better illustrated in FIG. 1B, extends radially inward and forms tooth 40 which is receivable in a notch 41 that is disposed in portion 38 of mandrel 10. FIG. 1C is a sectioned view of FIG. 1A better illustrating die 32 which has notch 42 that is capable of receiving mating tooth 43 which is attached to the die end of mandrel bridge 20. FIG. 1D is a pictorial view of the mandrel bridge 20 and die 32 separated from each other with their tooth 43 and notch 42 respectively in proper alignment for mating together. When tooth 40 is mated with notch 41 and tooth 43 is mated with notch 42, the proper relationship exists between mandrel 10, mandrel bridge 20, and die 32 for extruding the required hollow, elongated bodies of rectangular cross section.

Hydrostatic sealing between die 32 and billet 16 is provided by transition circle 44 contacting die surface 26A and B. Transition circle 44 on billet 16 marks the change between frusto conical surfaces 26A and B and 24A and B which have different conical apex angles as previously described. Sealing between billet 16 and mandrel 10 occurs at circle 46 which marks the beginning of cylindrical portion 48 of mandrel forming tip 12. Sealing is provided at circle 46 when transition circle 44 contacts die 32 and forces billet 16 radially inward into contact with mandrel tip 12. A wedge shaped volume bounded by surfaces 36A and B is filled with the pressurizable fluid which promotes good lubrication at the onset and throughout the extrusion process.

Figure 2:
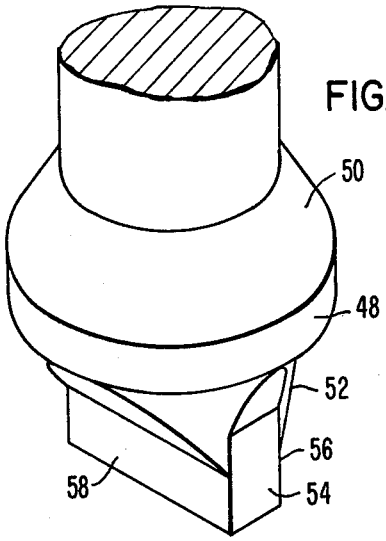
FIG. 2 is a pictorial view of a forming tip for the mandrel shown in FIG. 1A.
Figure 3A:
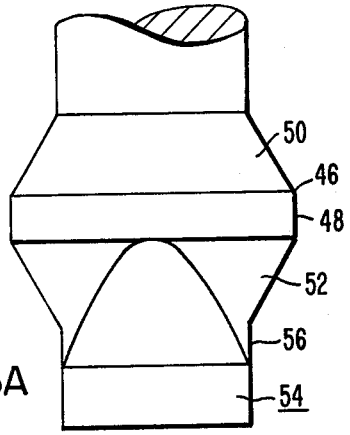
FIGS. 3A and 3B are orthogonal views of the mandrel tip which was illustrated in FIG. 2.
Figure 3B:
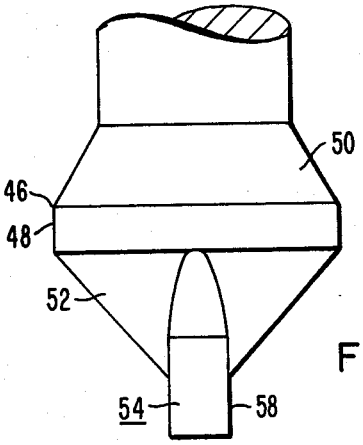

Mandrel tip 12, illustrated pictorially in FIG. 2, has a tapered portion 50 which expands from the main, axially extending body of mandrel 10 to form cylindrical portion 48. Cylindrical portion 48 is sized so as to have a close sliding fit with billet 16's radially inner surface. Cylindrical portion 48 changes shape across transition portion 52 and terminates on a rectangularly shaped portion 54. In the preferred embodiment, transition portion 52 comprises a frusto conical surface which is interrupted around its periphery by planes which are tangent to and extend from cylindrical portion 48 to the sides of rectangular portion 54 with each plane's width being equal to the rectangular portion's intersecting side. As can be seen in FIGS. 2, 3A and 3B, sides 56 of rectangular portion 54 extend farther than sides 58 in order to achieve a more uniform billet flow resulting in improved corner integrity of the product. Actual linear and angular dimensions for this invention must be adjusted for various materials, product dimensions, differing product extrusion temperatures, and differing product extrusion speeds. FIGS. 3A and 3B illustrate the mandrel tip portion of FIG. 2 shown in two orthogonal views thereof. While it is to be understood that transition portion 52 could be of different shape than a frusto conical form, increased diffficulty was experienced in producing a product of cross sectional configuration shown in FIG. 5. FIG. 6 illustrates the inside corner imperfections and flat side waviness previously experienced by Applicant which resulted in Applicant's development of this invention.

Figure 4:
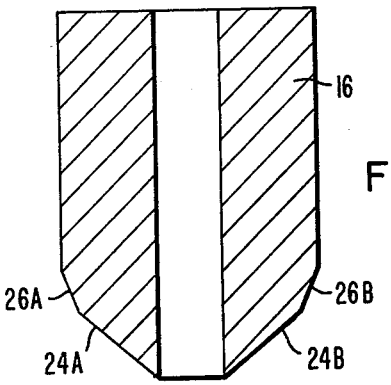
FIG. 4 is a section view of the billet illustrated in FIG. 1A.

FIG. 4 shows billet 16 with its simple leading end geometry comprising two frusto conical surfaces of differing apex angle whose purposes are three fold: (1) provide hydrostatic sealing between the billet and the die; (2) promote lubrication by the pressurizable fluid between billet 16 and die 32 especially at the start of extrusion; and (3) decrease the extrusion force necessary to form the hollow, elongated body of rectangular cross section.

Figure 5:
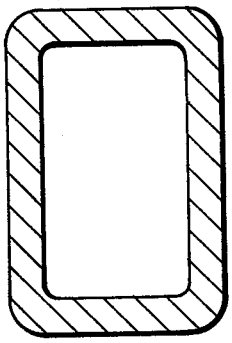
FIG. 5 is a cross section view of the product made from the hydrostatic extrusion apparatus shown in FIG. 1A.

While FIGS. 1A, 1B, 1C, 1D, 1E, 2, 3, and 4 illustrate the intersection of surfaces on the die and mandrel as discrete lines, it is to be understood that the intersections are often blended with each other by forming radii therebetween. The blending of intersecting surfaces promotes uniform workpiece flow between the die and mandrel and permits the formation of a final product having rounded corners as shown in FIG. 5.

I claim:

1. An apparatus for hydrostatically extruding hollow, open-ended bodies of generally rectangular cross section, said apparatus comprising:

a fluid-tight pressure chamber containing a pressure transmitting medium;

a die disposed in said pressure chamber and having an opening therethrough, said opening being bounded at a first end by a tapered entrance wall and at a second end by an exit wall having an opening of rectangular cross section;

a mandrel positioned in said pressure chamber, said mandrel having a forming end which cooperates with said die in providing an extrusion path therebetween, said forming end having a periphery that changes in an axial direction from a cylindrically shaped sealing surface through a transition portion to a rectangularly shaped portion with said transition portion having a surface constituting a series of planes disposed in alternating relation with a series of curved, tapered surfaces, said planes being tangent to and extending from said cylindrically shaped surface to the sides of said rectangularly shaped portion;

said die's tapered entrance wall including a first frusto conical surface having a first apex angle; and means for pressurizing said pressure transmitting medium whereby said extrusion is caused to occur.

2. The apparatus of claim 1, wherein said die and said mandrel's forming end each have intersecting surfaces which are smoothly blended at their intersection by forming radii therebetween.

3. The apparatus of claim 1, wherein said die's tapered entrance wall further comprises:

a second frusto conical surface disposed axially farther from said die's first end than said first frusto conical surface wherein said die's second frusto conical surface has a smaller apex angle than does said die's first frusto conical surface.

4. A mandrel used in hydrostatically extruding a billet into a hollow, open-ended body of generally rectangular cross section, said mandrel comprising:

a member having a forming end which cooperates with a die's bearing portion to form a channel therebetween causing uniform flow therethrough during hydrostatic extrusion, said forming end having a periphery which changes in an axial direction from a cylindrically shaped sealing surface through a transition portion to a rectangularly shaped portion with said transition portion having a surface constituting a series of planes disposed in alternating relation with a series of curved, tapered surfaces, said planes being tangent to and extending from said cylindrically shaped surface to the sides of said rectangularly shaped portion.

5. The mandrel of claim 4, wherein mandrel's forming end and said die's bearing portion each have intersecting surfaces thereon which are smoothly blended together by forming radii between those surfaces.

* * * * *